US010352208B2

(12) United States Patent
Shewell

(10) Patent No.: US 10,352,208 B2
(45) Date of Patent: Jul. 16, 2019

(54) ROCKER ARM WITH HYDRAULIC LASH ADJUSTMENT

(71) Applicant: SCHAEFFLER TECHNOLOGIES AG & CO. KG, Herzogenaurach (DE)

(72) Inventor: Jeffrey Shewell, Rochester, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 439 days.

(21) Appl. No.: 15/086,375

(22) Filed: Mar. 31, 2016

(65) Prior Publication Data

US 2017/0284237 A1 Oct. 5, 2017

(51) Int. Cl.

| | |
|---|---|
| ***F01L 1/18*** | (2006.01) |
| ***F01M 9/10*** | (2006.01) |
| ***F01L 1/24*** | (2006.01) |
| *F01L 1/46* | (2006.01) |
| *F01L 13/00* | (2006.01) |

(52) U.S. Cl.

CPC ..... *F01M 9/10* (2013.01); *F01L 1/181* (2013.01); *F01L 1/24* (2013.01); *F01L 2001/186* (2013.01); *F01L 2001/467* (2013.01); *F01L 2013/001* (2013.01); *F01L 2105/00* (2013.01); *F01L 2810/02* (2013.01)

(58) Field of Classification Search

CPC ..... F01L 1/25; F01L 25/02; F01L 1/24; F01L 1/181; F01L 2001/186; F01L 2810/02; F01M 9/10

USPC ..... 123/90.39, 90.44, 90.45, 90.46, 90.12

See application file for complete search history.

(56) References Cited

U.S. PATENT DOCUMENTS

| | | | | |
|---|---|---|---|---|
| 4,104,996 | A | 8/1978 | Hosono et al. | |
| 5,596,960 | A | 1/1997 | Hazen | |
| 5,758,620 | A * | 6/1998 | Warner | F01L 13/06 123/321 |
| 7,077,090 | B2 | 7/2006 | Sailer et al. | |
| 8,726,863 | B2 * | 5/2014 | Meistrick | F01L 1/08 123/90.15 |

* cited by examiner

*Primary Examiner* — Ching Chang

(74) *Attorney, Agent, or Firm* — Brooks Kushman P.C.

(57) ABSTRACT

A rocker arm assembly for an engine is configured to fit about a pivot shaft that extends along a central axis. The assembly includes an intermediate shaft configured to be rotatably disposed about the pivot shaft. A cam-side arm is pivotable about the central axis and is configured to be driven by a cam. A valve-side arm is pivotable about the central axis and relative to the cam-side arm, and is configured to convert rotation of the rocker arm assembly about the central axis into operation of an engine valve. An annular compressible fluid chamber is disposed between the intermediate shaft and the valve-side arm. When the cam-side arm and the intermediate shaft are engaged, pivoting of the cam-side arm compresses fluid within the chamber, causing corresponding pivoting of the valve-side arm and operation of the valve. The fluid provides hydraulic lash adjustment.

19 Claims, 4 Drawing Sheets

ROCKER ARM WITH HYDRAULIC LASH ADJUSTMENT

TECHNICAL FIELD

This disclosure relates to a rocker arm assembly with a hydraulic lash adjuster. More specifically, the rocker arm assembly has fluid passages arranged near a central region of the rocker arm assembly to allow hydraulic lash adjustment to take place near the central region.

BACKGROUND

Intake valves allow air to enter a combustion chamber of an internal combustion engine, and exhaust valves allow exhaust to exit the combustion chamber after combustion. Timing of the opening and closing of the valves can be controlled by a cam lobe that acts upon a rocker arm. For example, a cam lobe on a cam can engage with a cam follower on a rocker arm to enable rotational movement of the rocker arm. The rocker arm can mechanically engage a stem of the valve during rotation such that rotation of the rocker arm can push the stem to open the valve at timing intervals consistent with rotation of the cam.

Hydraulic lash adjustment is known in the art. For example, a hydraulic lash adjuster can remove lash in the system to ensure that all contacting bodies stay in contact through the entire rotation of the cam as the cam follower is ramped up and down the cam lobe. By keeping all contacting bodies in contact, the hydraulic lash adjuster reduces any translation of undesirable impact forces to the valve itself, and improves smooth linear operation of the valve stem.

SUMMARY

According to one embodiment, a rocker arm assembly for an engine has a cam-side arm, a valve-side arm, and a hydraulic rotary coupling. The cam-side arm is pivotable about a central axis and is configured to be driven by a cam. The valve-side arm is pivotable about the central axis, is pivotable relative to the cam-side arm, and is configured to operate an engine valve. The hydraulic rotary coupling is located at least partially about the central axis and hydraulically couples the cam-side arm to the valve-side arm. The hydraulic rotary coupling enables hydraulic adjustment of angular spacing between the valve-side arm relative to the cam-side arm about the central axis during operation of the engine.

In another embodiment, a rocker arm assembly for an internal combustion engine includes a first arm, a second arm, and a compressible fluid chamber. The first arm has a hub that is rotatable about an axis and defines a fluid passage that extends radially through the hub from an inner surface to an outer surface of the hub. The second arm is pivotally coupled to and about the outer surface of the hub. The compressible fluid chamber is fluidly connected to the fluid passage and is located radially between the second arm and the hub. Fluid in the chamber rotationally couples the first arm to the second arm as the hub rotates relative to the second arm.

In yet another embodiment, a rocker arm assembly for an internal combustion engine includes a pivot shaft that extends along a central axis. The pivot shaft has an outer surface. An intermediate shaft has an inner surface and an outer surface. The intermediate shaft is disposed at least partially about the pivot shaft and is rotatable about the central axis relative to the pivot shaft. The intermediate shaft defines a fluid passage extending radially therethrough. An arm is pivotable about the central axis. The arm has an inner surface disposed at least partially about the outer surface of the intermediate shaft. The outer surface of the intermediate shaft and the inner surface of the arm cooperate to define a fluid chamber fluidly coupled to the fluid passage and configured to enable fluid therein to provide hydraulic lash adjustment

DETAILED DESCRIPTION

Figure 1:
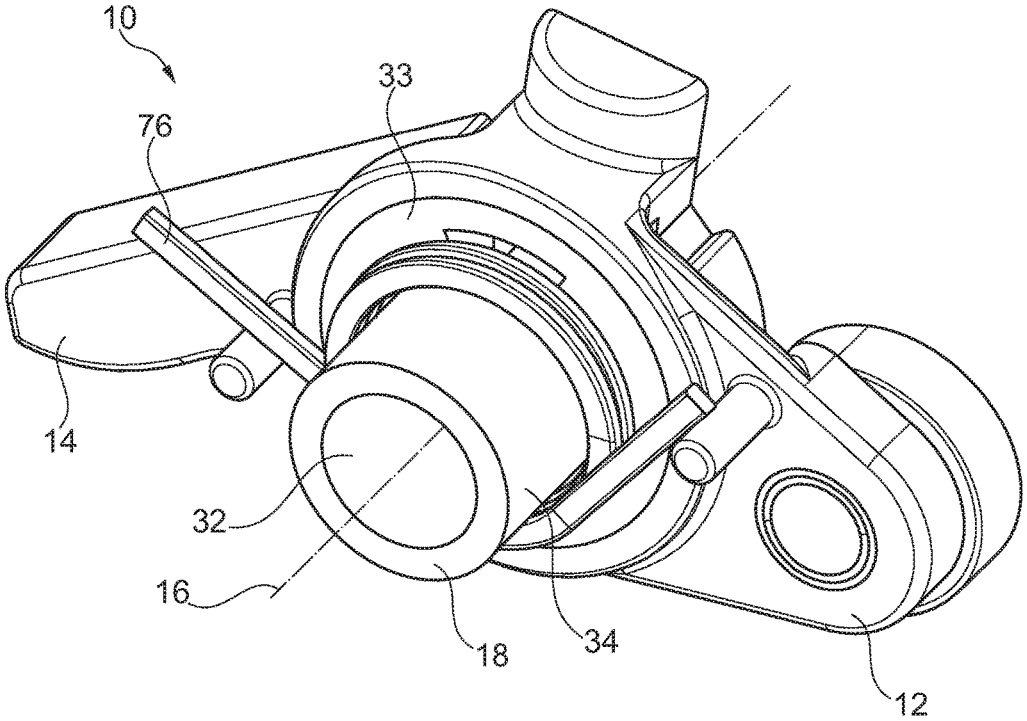
FIG. 1 is a front perspective view of a portion of an exemplary rocker arm assembly with a rear portion being cutaway for illustrative purposes in other figures.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Referring to the Figures, a rocker arm assembly 10 is provided. As will be described below, the rocker arm assembly 10 includes a hydraulic lash adjustment mechanism located at a central region of the assembly. As will also be described below, the rocker arm assembly 10 is a switchable rocker arm assembly configured to deactivate valves of associated cylinders for fuel-efficiency purposes. However, the hydraulic lash adjustment of the present disclosure is not intended to be limited to only switchable rocker arm assemblies.

The rocker arm assembly 10 has a first arm 12 and a second arm 14. Each arm 12, 14 is pivotable about a central axis 16. In one embodiment, the first arm 12 is a cam-side arm, in that it is located above and configured to be driven by a cam (not shown). For example, a cam can intermittently cause a cam follower to move up and down, thereby causing rotation of the cam-side arm about the central axis. The second arm 14 can be a valve-side arm, in that it is located above and configured to drive an associated engine valve (not shown). As will be described below, the first and second arms 12, 14 can sometimes rotate together as one locked unit being driven by the cam. At other times (e.g., when an engine cylinder is desired to be deactivated), the arms 12, 14 can be unlocked in that movement of the cam-side arm does not cause a direct and corresponding movement of the valve-side arm about the central axis. In this fashion, the arms 12, 14 are selectively pivotable about the axis and pivotable with respect to one another.

The rocker arm assembly 10 also includes a pivot shaft 18 extending along and about the central axis 16. The pivot shaft 18 can be fixed such that the arms 12, 14 pivot relative to the pivot shaft 18 about the central axis 16. The pivot shaft 18 has a hollow interior for transferring lubricating fluid to various fluid passages within the arms and intermediate shaft, as will be described below.

Figure 2:
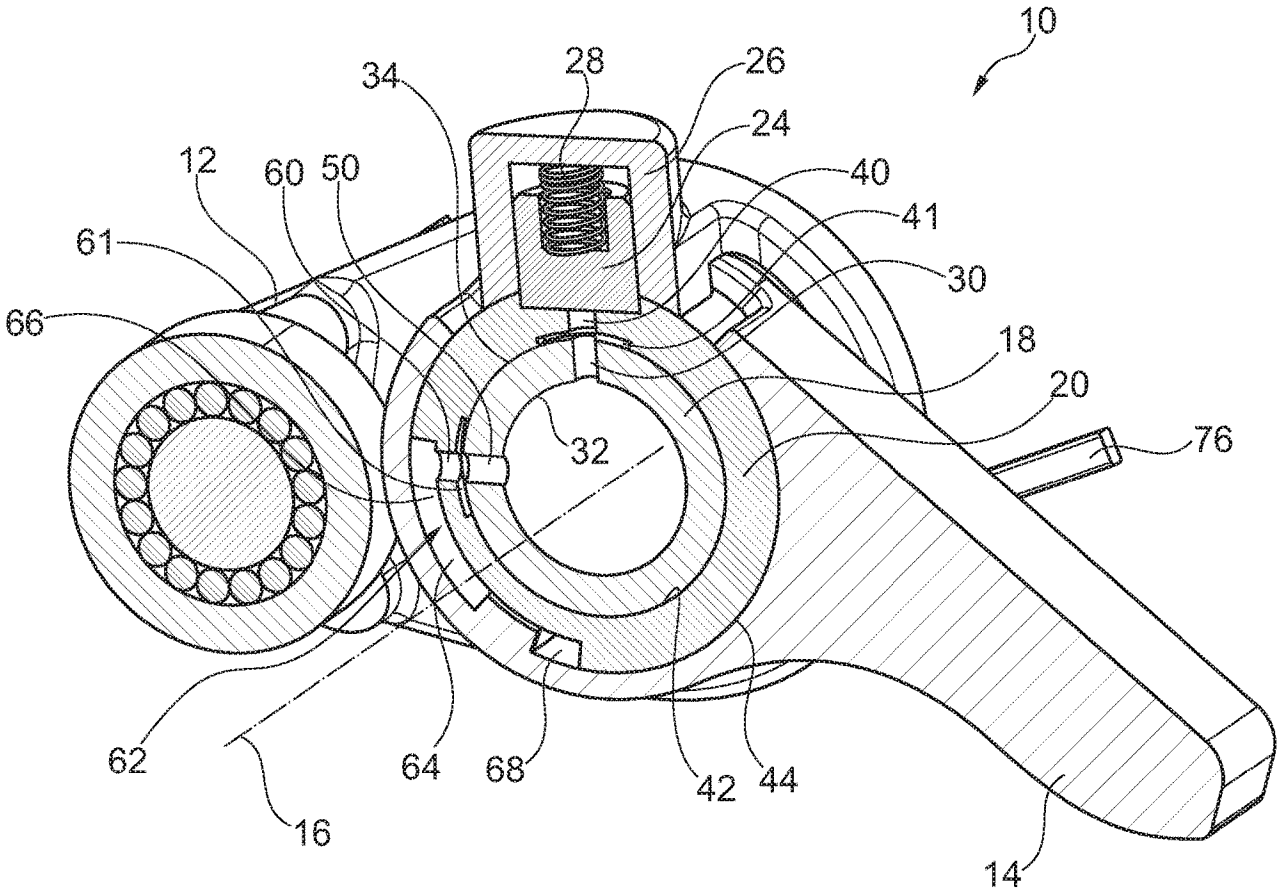
FIG. 2 is a rear perspective cross-sectional view of the rocker arm assembly of FIG. 1.
Figure 3A:
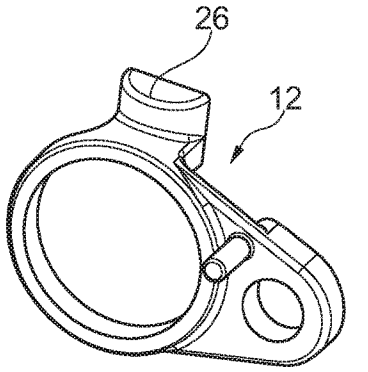
FIG. 3A is a front perspective view of a cam-side arm of the rocker arm assembly of FIG. 1 with the rear portion being cutaway for illustrative purposes in FIG. 3B.
Figure 3B:
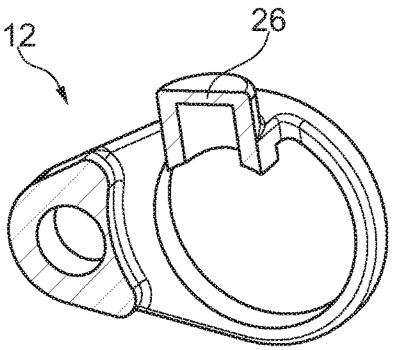
FIG. 3B is a rear perspective cross-sectional view of the cam-side arm of FIG. 3A.
Figure 5:
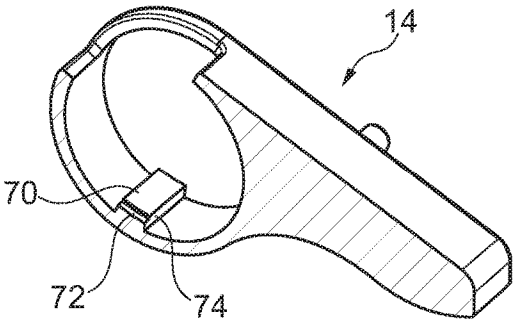
FIG. 5 is a rear perspective view of a valve-side arm of the rocker arm assembly of FIG. 1.
Figure 4A:
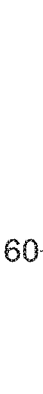
FIG. 4A is a top perspective cross-sectional view of an intermediate shaft of the rocker arm assembly of FIG. 1.
Figure 4B:
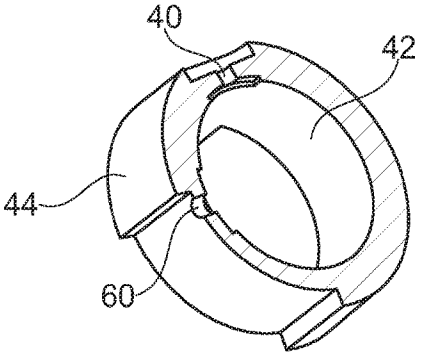
FIG. 4B is a bottom perspective cross-sectional view of the intermediate shaft of FIG. 4A.
Figure 6:
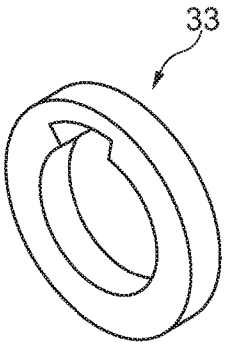
FIG. 6 is a front perspective view of a portion of an end cap of the rocker arm assembly of FIG. 1.

An intermediate shaft 20 also extends along the central axis 16. The intermediate shaft 20 is rotatable about the central axis 16, and is rotatable relative to both the pivot shaft 18 and the second arm 14. The intermediate shaft 20 is located radially inward from both arms 12, 14 with respect to the central axis 16. In one embodiment shown in FIG. 2, the second arm 14 is directly but pivotally connected about the intermediate shaft 20.

As mentioned above, the rocker arm assembly 10 can be configured to selectively disable combustion in an engine cylinder by deactivating the associated valves. The Figures illustrate the structure enabling such function according to one embodiment. A locking pin 24 is housed within a locking pin housing 26 defining an interior region of the first arm 12. The locking pin 24 is biased via a spring 28 to mechanically lock the first arm 12 with the intermediate shaft 20. When in this locked position, pivoting of the first arm 12 due to the cam causes a direct corresponding rotation of the intermediate shaft 20 about the central axis 16. As will be described below, the rotation of the intermediate shaft 20 also causes movement of the second arm 14 via hydraulic pressure, opening and closing the associated valve.

The locking pin 24 can also be unlocked to allow for relative movement between the first arm 12 and the intermediate shaft 20. The pivot shaft 18 is provided with a first fluid passage 30 extending radially outward from an inner surface 32 to an outer surface 34 of the pivot shaft 18. The intermediate shaft 20 includes a corresponding first fluid passage 40 extending radially outward from an inner surface 42 to an outer surface 44 of the intermediate shaft 20. These fluid passages 30, 40 cooperate to enable lubrication or oil within the interior of the pivot shaft 18 to act upon the locking pin 24. For example, when it is desired to unlock the locking pin 24, fluid pressure within the pivot shaft 18 can be commanded and controlled such that the fluid pressure travels through the first fluid passages 30, 40, causing the locking pin 24 to push against the spring 28 and deeper into the housing 26. This unlocks the first arm 12 from the intermediate shaft 20, which inhibits pivoting of the first arm 12 (caused by the cam) to translate into rotation of the intermediate shaft 20. Because the second arm 14 is hydraulically driven by rotation of the intermediate shaft 20 according to one or more embodiments, the unlocking of the locking pin 24 allows the first arm 12 to pivot without causing a corresponding pivoting movement of the second arm 14.

The intermediate shaft 20 further defines a first pocket 41 in fluid communication with the first fluid passages 30, 40. The pocket 41 extends circumferentially about the central axis 16. The pocket defines a fluid-traveling region that maintains fluid communication between the first fluid passages 30, 40 even while the intermediate shaft 20 moves relative to the pivot shaft 18.

An end cap 33 provides a boundary for the hydraulic rotary coupling device between the two arms 12, 14, and also inhibits debris and the like from entering the fluid passages.

If locking of the pin 24 is requested to re-enable an engine cylinder valve, the fluid pressure in the pivot shaft 18 can be commanded to reduce, allowing the spring 28 to bias the locking pin 24 back into engagement with the intermediate shaft 20.

As previously mentioned, the second arm 14 can be hydraulically pivoted in response to rotation of the intermediate shaft 20. The pivot shaft 18 is provided with a second fluid passage 50 which extends radially outward from the inner surface 32 to the outer surface 34 of the pivot shaft 18. And, the intermediate shaft 20 includes a corresponding second fluid passage 60 extending radially outward from the inner surface 42 to the outer surface 44 of the intermediate shaft 20. These fluid passages 50, 60 cooperate to enable lubrication or oil within the interior of the pivot shaft 18 to flow into a fluid chamber 62 defined between an inner surface 64 of the second arm 14 and the outer surface 44 of the intermediate shaft 20.

Pressurized fluid in the fluid chamber 62 causes rotation of the intermediate shaft 20 to translate into pivoting movement of the second arm 14, which causes the associated valve to open and close. In one embodiment, the fluid chamber 62 includes a low-pressure chamber 66 and a high-pressure chamber 68 separated by a projection 70. In one embodiment, the projection 70 extends inwardly from the inner surface 64 of the second arm. The projection 70 can also define a groove or vein 72 fluidly coupling the low-pressure chamber 66 with the high-pressure chamber 68. Pressurized fluid from the pivot shaft 18 flows through the second fluid passages 50, 60, into the low-pressure chamber 66, through the vein 72, and into the high-pressure chamber 68. A valve, such as a one-way valve or a reed valve, can be disposed within or adjacent to the vein 72 at or near a location labeled 74 to enable fluid to flow into the high-pressure chamber 68 but inhibit the fluid from returning back into the low-pressure chamber 66.

When the fluid chamber 62 is pressurized with fluid, rotation of the intermediate shaft 20 causes pivoting of the second arm 14. Specifically, the pressurized fluid within the high-pressure chamber 68 is entrapped therein or is at least partially inhibited from exiting. Thus, when the intermediate shaft is rotated, the pressurized fluid within the high-pressure chamber 68 acts upon the projection 70 of the second arm 14, causing the second arm 14 to correspondingly pivot about the central axis 16.

The intermediate shaft 20 further defines a second pocket 61 in fluid communication with the second fluid passages 50, 60. The pocket 61 extends circumferentially about the central axis 16. The pocket defines a fluid-traveling region that maintains fluid communication between the second fluid passages 50, 60 even while the intermediate shaft 20 moves relative to the pivot shaft 18. It should be understood that the structure of the pockets 41, 61 illustrated in the figures is merely exemplary; for example, the pockets 41, 61 can be formed in the pivot shaft 18.

Figure 7A:
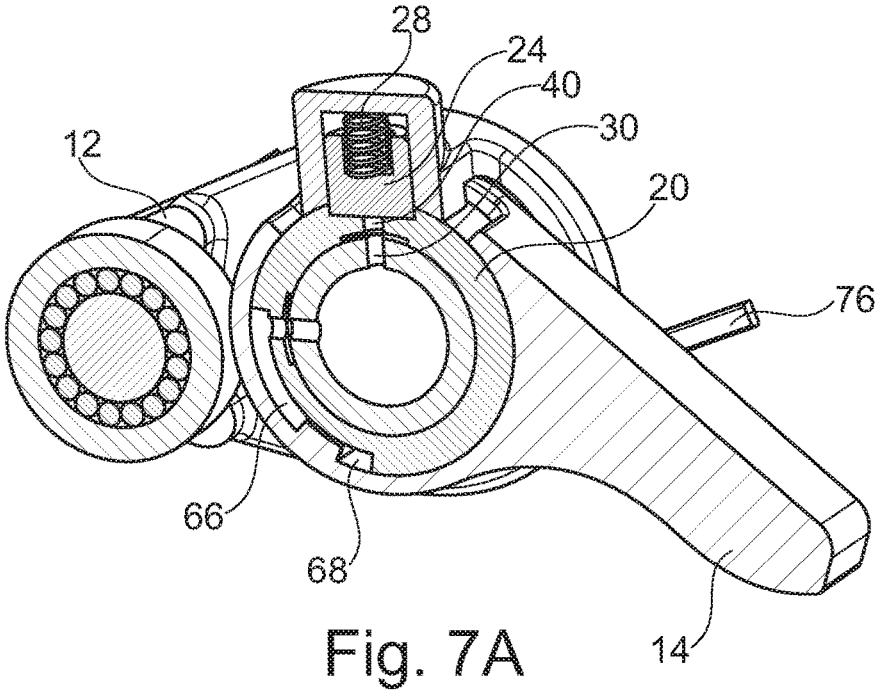
FIG. 7A is a rear perspective cross-sectional view of the rocker arm assembly of FIG. 1, similar to FIG. 2, in which the rocker arm assembly is in a locked position.
Figure 7B:
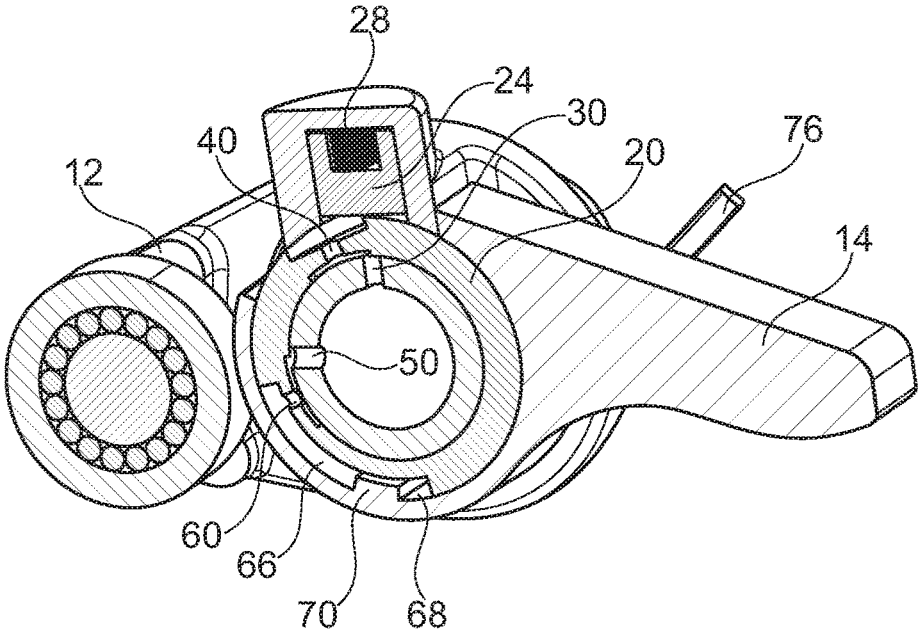
FIG. 7B is a rear perspective cross-sectional view of the rocker arm assembly of FIG. 7A in which the rocker arm assembly is in an unlocked position.

In operation, from the perspective of FIGS. 7A and 7B, the cam acts upon the first arm 12 and causes the first arm 12 to pivot clockwise. If the locking pin 24 is in the locked position (FIG. 7A), the intermediate shaft 20 also rotates clockwise. The fluid in the high-pressure chamber 68 acts upon the projection 70, causing the second arm 14 to also pivot clockwise and act upon the associated valve. If the locking pin 24 is in the unlocked position (FIG. 7B), the first arm 12 can pivot freely without causing corresponding clockwise rotation of the intermediate shaft 20 or clockwise pivoting of the second arm 14. The intermediate shaft 20 can rotate with respect to the first arm 12, while the fluid passages 30, 40 and 50, 60 remain in fluid communication with one another due to the pockets 41, 61.

A lost-motion spring 76 can maintain the second arm 14 in a fixed position as the first arm 12 rotates. The spring 76 can engage the first and second arms 12, 14 at projections, as shown in FIG. 1. The spring 76 provides a biasing force against the first and second arms 12, 14 such that, in the orientation shown in FIG. 1, the first arm 12 is biased clockwise and the second arm 14 is biased counter-clockwise.

The structure described above provides hydraulic lash adjustment at a central region about the central axis 16 radially between the first and second arms. The fluid chamber 62 provides a hydraulic rotary coupling between the first and second arms 12, 14, in that rotational movement is transferred hydraulically between the first and second arms 12, 14. The fluid chamber 62 also enables hydraulic lash adjustment to take place therein. Moreover, combined forces from the lost-motion spring 76 and the fluid within the fluid chamber 62 ensure that the cam-follower closely follows the profile of the cam during operation.

The lost-motion spring 76 also acts as a hydraulic lash adjustment spring. When there is lash in the system, the lost-motion spring 76 rotates the first and second arms downward (from the perspective of FIGS. 1-2) so that they contact the cam and valve stem. This causes a vacuum in the high-pressure chamber 68, enabling fluid flow from the low-pressure chamber 66 to the high-pressure chamber 68. When the cam lobe begins to act on the cam follower, the valve 74 in the vein 72 closes, causing an elevated pressure in the high-pressure chamber 68 and effectively causing the intermediate shaft 20 and second arm 14 to rotate together, as explained above. With this structure, no additional spring is necessary within the high-pressure chamber 68 to act as the lash adjuster.

In an embodiment in which the rocker arm assembly 10 is not a switchable rocker arm capable of selectively disabling an engine cylinder, the first arm 12 and the intermediate shaft 20 can be a single integrally-formed piece. This alleviates the need for the locking pin. In any switchable or non-switchable rocker arm embodiment, the intermediate shaft and the region of the first arm extending about the central axis can either individually or collectively be referred to as a hub, that rotates about the central axis.

With the teachings of the embodiments described above, the hydraulic lash adjustment can occur in hydraulic fluid passages arranged annularly about the central axis. Hydraulic lash adjustment occurring at a central region of the rocker arm assembly provides significant benefits compared to previous hydraulic lash adjustment mechanisms that are located at an outer region of one of the arms (e.g., the valve-side arm). For example, having hydraulic lash adjustment mechanisms at an end of one of the arms can add weight to that arm far from the central rotational axis. This can increase the moment of inertia.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A rocker arm assembly for an engine, comprising:

a cam-side arm pivotable about a central axis and configured to be driven by a cam;

a valve-side arm pivotable about the central axis, pivotable relative to the cam-side arm, and configured to operate an engine valve;

a hydraulic rotary coupling about the central axis that hydraulically couples the cam-side arm to the valve-side arm, wherein the hydraulic rotary coupling enables hydraulic adjustment of angular spacing between the valve-side arm relative to the cam-side arm about the central axis during operation of the engine; and an intermediate shaft extending along the central axis and having an inner surface and an outer surface, wherein the hydraulic rotary coupling includes an arcuate fluid chamber defined radially between the outer surface of the intermediate shaft and an inner surface of either the cam-side arm or the valve-side arm.

2. The rocker arm assembly of claim 1, wherein the intermediate shaft is pivotable about the central axis relative to both the cam-side arm and the valve-side arm.

3. The rocker arm assembly of claim 2, wherein the valve-side arm has an inner surface, and the arcuate fluid chamber is located radially between the outer surface of the intermediate shaft and the inner surface of the valve-side arm.

4. The rocker arm assembly of claim 3, wherein the intermediate shaft defines a fluid passage extending radially between the inner and outer surfaces thereof, and the fluid passage fluidly couples an interior of the intermediate shaft with the fluid chamber.

5. The rocker arm assembly of claim 1, further comprising a protrusion extending radially inward from the valve-side arm or radially outward from the intermediate shaft, the protrusion separating the fluid chamber into a low-pressure chamber and a high-pressure chamber.

6. The rocker arm assembly of claim 5, wherein the protrusion defines a vein that fluidly connects the low-pressure chamber with the high-pressure chamber, and the rocker arm assembly further comprises a valve disposed between the low-pressure chamber with the high-pressure chamber, wherein the valve is configured to inhibit fluid flow from the high-pressure chamber to the low-pressure chamber.

7. A rocker arm assembly for an internal combustion engine, comprising:

a first arm having a hub rotatable about an axis, the hub defining fluid passage extending radially therethrough from an inner surface to an outer surface thereof;

a second arm pivotally coupled about the outer surface of the hub; and a compressible fluid chamber fluidly connected to the fluid passage and located radially between the second arm and the hub, wherein fluid in the compressible fluid chamber rotationally couples the first arm to the second arm as the hub rotates relative to the second arm.

8. The rocker arm assembly of claim 7, wherein the hub is an intermediate shaft configured to lock and unlock with the first arm, and wherein the hub is rotatable relative to both the first arm and the second arm.

9. The rocker arm assembly of claim 8, further comprising a pivot shaft extending along the axis and disposed radially inward from the intermediate shaft, the pivot shaft defining a fluid passage extending radially therethrough and fluidly connected to the fluid passage of the hub to enable fluid to pass through the pivot shaft, through the hub, and into the fluid chamber to provide hydraulic lash adjustment.

10. The rocker arm assembly of claim 8, wherein the intermediate shaft includes an outer surface, and the second arm includes an arcuate inner surface that cooperates with the outer surface of the intermediate shaft to define the fluid passage.

11. The rocker arm assembly of claim 7, wherein the fluid chamber is separated into a high-pressure fluid chamber and a low-pressure fluid chamber by a radially-extending protrusion.

12. The rocker arm assembly of claim 11, wherein the radially-extending protrusion extends from an arcuate inner surface of the second arm.

13. The rocker arm assembly of claim 11, wherein the protrusion defines a vein fluidly connecting the low-pressure fluid chamber to the high-pressure fluid chamber, and wherein the rocker arm assembly further includes a valve connected to the protrusion and configured to inhibit fluid flow from the high-pressure fluid chamber to the low-pressure fluid chamber.

14. A rocker arm assembly for an internal combustion engine, comprising:

a pivot shaft extending along a central axis and having an outer surface;

an intermediate shaft having an inner surface and an outer surface, the intermediate shaft disposed at least partially about the pivot shaft and rotatable about the central axis relative to the pivot shaft, the intermediate shaft defining a fluid passage extending radially therethrough; and an arm pivotable about the central axis, the arm having an inner surface disposed at least partially about the outer surface of the intermediate shaft;

wherein the outer surface of the intermediate shaft and the inner surface of the arm cooperate to define a fluid chamber fluidly coupled to the fluid passage and configured to enable fluid therein to provide hydraulic lash adjustment.

15. The rocker arm assembly of claim 14, wherein the inner surface of the arm or the outer surface of the intermediate shaft includes a projection extending into the fluid chamber and separating the fluid chamber into a high-pressure chamber and a low-pressure chamber.

16. The rocker arm assembly of claim 15, wherein the projection defines a vein fluidly coupling the high-pressure chamber with the low-pressure chamber.

17. The rocker arm assembly of claim 16, further comprising a valve configured to inhibit fluid flow from the high-pressure chamber into the low-pressure chamber to enable compression of fluid in the high-pressure chamber as the arm moves relative to the intermediate shaft.

18. The rocker arm assembly of claim 15, wherein the arm is a valve-side arm, and wherein the assembly further includes a cam-side arm pivotally connected to the valve-side arm and a spring coupling the cam-side arm to the valve-side arm, wherein no additional spring is provided in the high-pressure chamber.

19. The rocker arm assembly of claim 14, wherein the fluid passage extends radially outward from the pivot shaft, and the intermediate shaft defines a circumferentially-extending pocket extending from the fluid passage.

* * * * *